US009801262B1

(12) United States Patent
Helms

(10) Patent No.: US 9,801,262 B1
(45) Date of Patent: Oct. 24, 2017

(54) CONDUIT KNOCKOUT INTERFACE DEVICE FOR CONNECTING A POWER OVER ETHERNET CABLE TO AN LED LUMINAIRE

(71) Applicant: Universal Lighting Technologies, Inc., Madison, AL (US)

(72) Inventor: John Helms, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 15/146,104

(22) Filed: May 4, 2016

Related U.S. Application Data

(60) Provisional application No. 62/157,761, filed on May 6, 2015.

(51) Int. Cl.
*H05B 37/02* (2006.01)
*H05B 33/08* (2006.01)
*F21K 99/00* (2016.01)

(52) U.S. Cl.
CPC ..... *H05B 37/0254* (2013.01); *F21K 9/17* (2013.01); *H05B 33/0842* (2013.01)

(58) Field of Classification Search
CPC ..... H05B 37/0254; H05B 37/0263; H05B 33/0842
See application file for complete search history.

(56) References Cited

U.S. PATENT DOCUMENTS 6,431,722 B1 * 8/2002 Benensohn ..... A47B 97/00 362/133
7,587,289 B1 * 9/2009 Sivertsen ..... F21K 9/00 362/147
8,558,413 B1 * 10/2013 Lepard ..... F21V 33/0052 307/150
2004/0073597 A1 * 4/2004 Caveney ..... H04L 12/10 709/200
2006/0165097 A1 * 7/2006 Caveney ..... H04B 3/44 370/395.53
2013/0182416 A1 * 7/2013 Wilson ..... F21S 8/04 362/147
2016/0071486 A1 * 3/2016 Byers ..... H04N 9/3147 345/690
2016/0164688 A1 * 6/2016 Yseboodt ..... H05B 37/0254 307/1
2016/0227629 A1 * 8/2016 Conner ..... H05B 33/0857
2016/0313386 A1 * 10/2016 Bugaris ..... G01R 31/026

* cited by examiner

*Primary Examiner* — Jason M Crawford
(74) *Attorney, Agent, or Firm* — Patterson Intellectual Property Law, P.C.; Mark J. Patterson; Garrett M. Hausman

(57) ABSTRACT

A power over Ethernet (PoE) interface device includes a knockout adapter. The knockout adapter is configured for mounting to a conduit knockout opening in an LED luminaire. The interface device includes a power assembly having an input section and an output section. The power assembly is connected to the knockout adapter such that the output section is positioned inside the luminaire when the knockout adapter is mounted to the luminaire. The power assembly further includes a data connector mounted to the input section. The data connector is configured to receive PoE signals from a data cable coupled to the data connector. Power output terminals are mounted to the output section and electrically coupled to the data connector. The power output terminals may be configured to couple the PoE signals from the data connector to an LED light source in the luminaire.

20 Claims, 4 Drawing Sheets

CONDUIT KNOCKOUT INTERFACE DEVICE FOR CONNECTING A POWER OVER ETHERNET CABLE TO AN LED LUMINAIRE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: U.S. Provisional Patent Application No. 62/157,761 filed May 6, 2015.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to powering a luminaire. More particularly, the present invention pertains to devices to facilitate powering an LED luminaire using ports from a power-over-Ethernet router.

Typically, a lighting fixture containing an incandescent or gas discharge lighting source is powered from a conventional AC or DC power bus that runs through a building and to one or more lighting fixtures through an adjacent conduit. However, a luminaire that contains an LED light source presents opportunities for receiving power from sources other than a conventional power bus, including in parts of a building where such a power bus is not present.

BRIEF SUMMARY OF THE INVENTION

The present invention relates to a power over Ethernet (PoE) interface device for use with an LED luminaire. The PoE interface device may include a knockout adapter. The knockout adapter may be configured for mounting to a conduit knockout opening in a luminaire. The PoE interface device may also include a power assembly. The power assembly may have an input section and an output section. The power assembly may be connected to the knockout adapter such that the output section of the power assembly is positioned inside a luminaire when the knockout adapter is mounted to the luminaire. The power assembly may further include a data connector mounted to the input section of the power assembly. The data connector may be configured to receive PoE signals from a data cable coupled to the data connector. The power assembly may also further include power output terminals mounted to the output section of the power assembly and electrically coupled to the data connector. The power output terminals may be configured to couple PoE signals from the data connector to an LED light source in the luminaire.

Another embodiment may include the power assembly further including a circuit board mounted to the output section of the power assembly. The power output terminals may be coupled to the data connector through the circuit board.

Yet another embodiment may include the circuit board including powered device circuitry configured to allow a PoE protocol to detect and classify the luminaire.

Still another embodiment may include the data connector configured to receive power from a power sourcing equipment.

A further embodiment may include the power sourcing equipment including a PoE router.

Some embodiments may include the power output terminals configured to send power to the light source.

One embodiment may include the knockout adapter including a circular outer perimeter to fit a corresponding circular knockout opening.

Another further embodiment may include the circular outer perimeter including a helical thread.

Yet another embodiment may include the knockout adapter including a plurality of retaining clips.

In some embodiments, the circular outer perimeter may include a diameter of 0.5 inches.

In other embodiments, the circular outer perimeter may include a diameter of 0.75 inches.

The present invention also relates to a power over Ethernet (PoE) interface device for a luminaire including a knockout opening and a light source. The PoE interface device may include a knockout adapter. The knockout adapter may be configured to fit the knockout opening. The PoE interface device may also include circuitry connected to the knockout adapter. The circuitry may include a power source connector and a power output connector.

Some embodiments may include the power source configured to receive power from a power sourcing equipment.

Further embodiments may include the power sourcing equipment including a PoE router.

Still further embodiments may include the circuitry configured to allow the PoE router to detect and classify the luminaire.

Another embodiment may include the knockout adapter further configured to maintain its position in the knockout opening and to prevent removal up to a threshold removal force.

Still another embodiment may include the knockout opening being 0.5 inches in diameter.

Other embodiments may include the knockout opening being 0.75 inches in diameter.

Yet another embodiment may include the knockout adapter located in the knockout opening of the luminaire, the power source connector electrically connected to a PoE router, and the power output connector electrically connected to the light source, the light source including at least one light emitting diode.

The present invention further relates to a method of powering a luminaire. The method may include providing a luminaire including a knockout opening with a knockout adapter mounted therein; providing power from a power over Ethernet (PoE) router to a power input connector mounted to the knockout adapter; detecting and classifying the luminaire in a PoE protocol; transferring power from the power input connector to a power output connector; and transferring power from the power output connector to a light source of the luminaire.

DETAILED DESCRIPTION OF THE INVENTION

Figure 1:
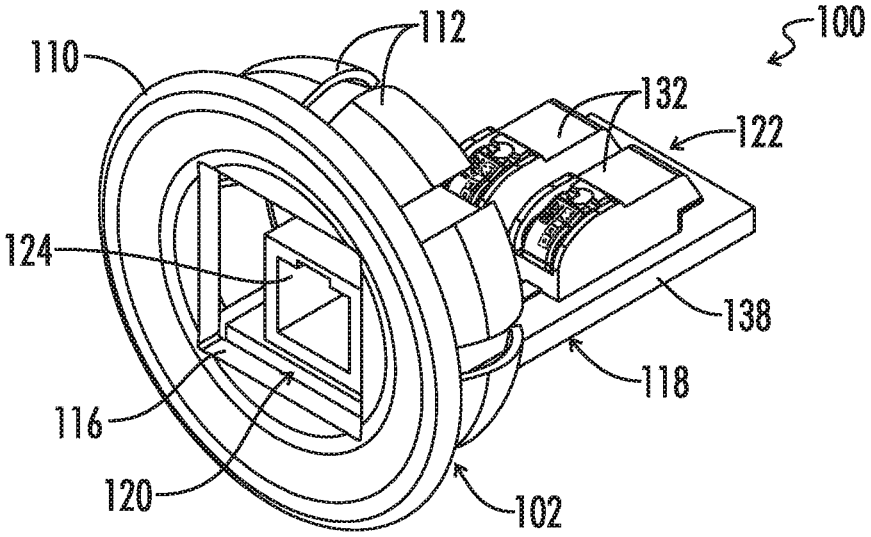
FIG. 1 is a perspective view of an embodiment of a power over Ethernet interface device.
Figure 2:
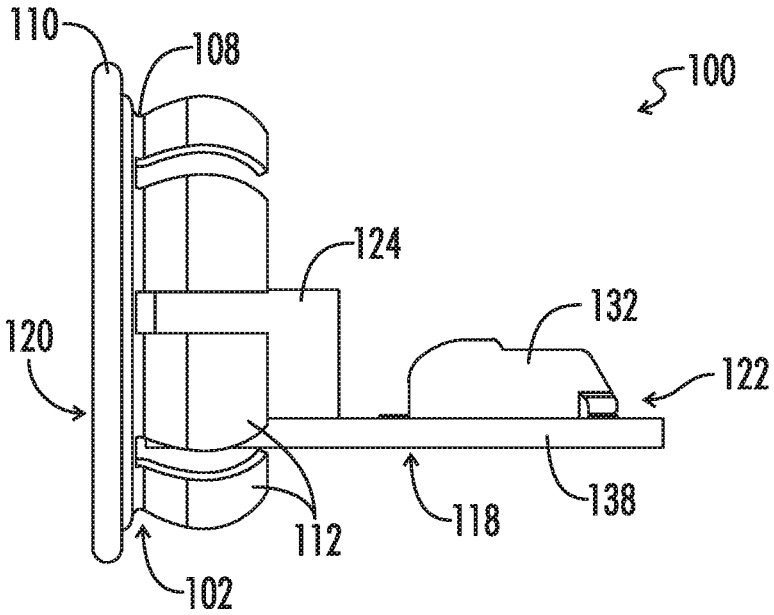
FIG. 2 is a left side elevation view of the power over Ethernet interface device of FIG. 1, the right side elevation view being a mirror image thereof.
Figure 3:
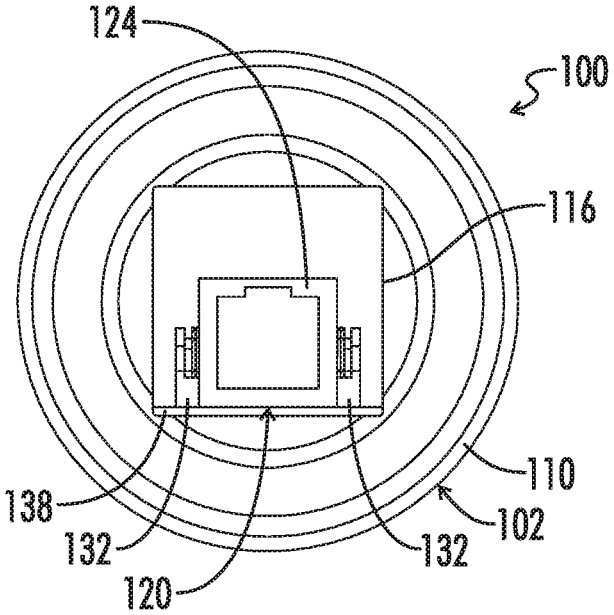
FIG. 3 is a front elevation view of the power over Ethernet interface device of FIG. 1.
Figure 4:
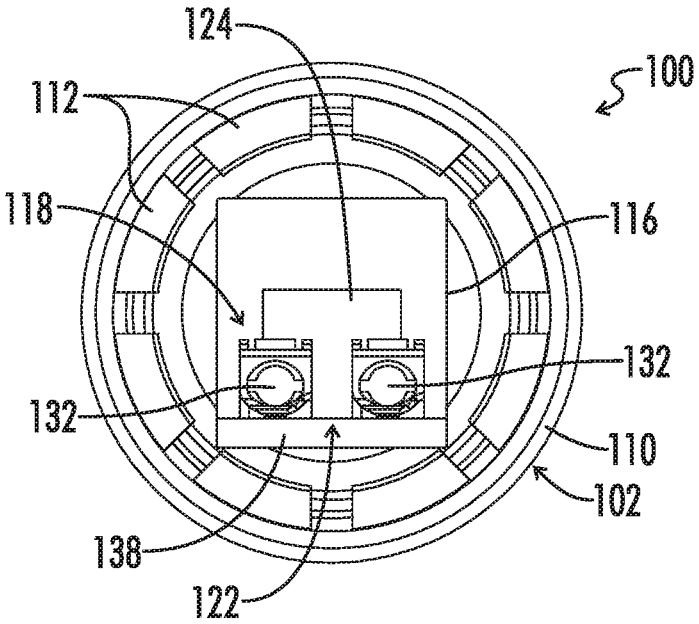
FIG. 4 is a back elevation view of the power over Ethernet interface device of FIG. 1.
Figure 5:
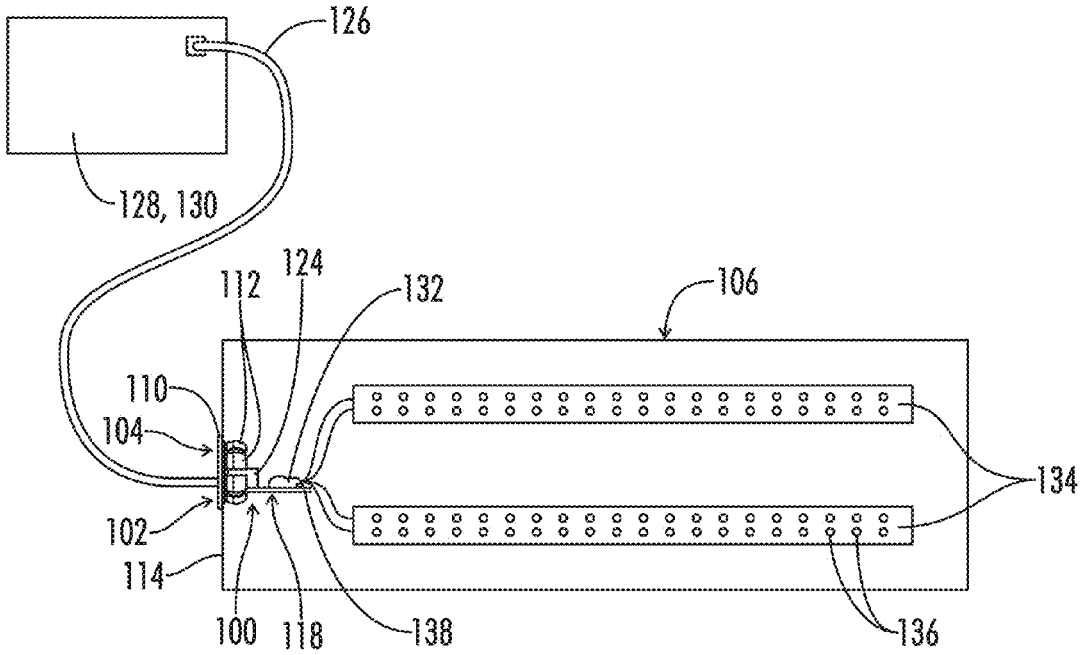
FIG. 5 is a schematic diagram of the power over Ethernet interface device of FIG. 1 installed in a luminaire and connected to a router.

The present invention will now be described with reference to the accompanying drawings. Many embodiments are contemplated. The disclosure should not, however, be construed to be limited to the embodiments set forth herein.

The present invention relates to a power over Ethernet (PoE) interface device 100 as shown in FIGS. 1-5. The interface device 100 includes a knockout adapter 102. The knockout adapter 102 is configured by geometry and dimensions to mount the interface device 100 to a conduit knockout opening 104. The conduit opening 104 may be contained in a panel 107 of a housing 105 associated with respective luminaire 106.

The knockout adapter 102 may be configured to fit any correspondingly shaped knockout opening 104. In one exemplary embodiment, the knockout adapter 102 may have a circular outer perimeter 108 to fit a corresponding circular knockout opening 104. This circular outer perimeter 108 may be smooth, grooved, or the like. The circular outer perimeter 108 may, in some embodiments, include helical threads such that the interface device 100 may be screwed into place in the knockout opening 104. In one embodiment, the circular outer perimeter 108 has a diameter of about 0.5 inches, such that the interface device 100 may fit a corresponding 0.5 inch diameter knockout opening 104 in a luminaire 106. In another embodiment, the circular outer perimeter 108 may have a diameter of about 0.75 inches, such that the interface device 100 may fit a corresponding 0.75 inch diameter knockout opening 104 in a luminaire 106.

The knockout adapter 102 may also include an exterior flange 110 configured to extend diametrically beyond an associated knockout opening 104 when the interface device 100 is installed in the knockout opening. This exterior flange 110 may be decorative, functional, or both. The exterior flange 110 may aid in retaining the interface device 100 in place once it is installed in the knockout opening 104. In some embodiments, the exterior flange 110, or the circular outer perimeter 108 may include a gasket (not shown) so as to aid in preventing particulate contaminants from entering the interior of the luminaire 106.

In some embodiments, the knockout adapter 102 may further include a plurality of retaining clips 112. These retaining clips 112 may be resilient members that press outward against the perimeter wall 114 of the knockout opening 104. In such an embodiment, a user may press the interface device 100 against the luminaire panel 107, thereby pressing the retaining clips inward with the perimeter wall 114 of the knockout opening 104. Once the interface device 100 has been moved beyond a threshold distance into the knockout opening 104, the retaining clips 112 resiliently expand and, therefore, bring the interface device into a position such that the perimeter wall 114 rests near the outer perimeter 108 of the knockout adapter 102. Once in place, the interface device 100 may only be removed from the knockout opening 104 by applying a force on the interface device outward from the luminaire 106 that is greater than a threshold removal force. The retaining clips 112 may be integrally molded with the knockout adapter 102 or hingedly attached thereto. In some embodiments, the interface device 100 may include retaining devices of any type including, but not limited to, clips, bolts, screws, glue, slots and pegs, and the like.

The knockout adapter 102 may also include a power assembly receiver opening 116. The power assembly receiver opening 116 may be any appropriate size and shape to receive a corresponding power assembly 118 of the interface device 100 mounted therein.

The power assembly 118 may include an input section 120 and an output section 122. The power assembly 118 may be connected to the knockout adapter 102 such that the output section 122 is positioned inside the luminaire 106 when the knockout adapter is mounted to the luminaire.

The input section 120 may have a data connector 124 mounted thereto. The data connector (or power source connector) 124 may be configured to receive PoE signals from a data cable 126 that is coupled to the data connector. The data cable 126 may be any appropriate data cable including, but not limited to, PoE Ethernet cables such as category 5 (CAT5), CAT5e, CAT6, CAT6A, and other cables. In some embodiments, the data connector 124 is configured to receive power from a power source 128. One non-limiting, exemplary embodiment of an appropriate power source 128 is a PoE router 130.

The output section 122 may have power output terminals (or power output connector) 132 mounted thereto. The power output terminals 132 may be electrically coupled to the data connector 124. The power output terminals 132 are configured to couple PoE signals from the data connector 124 to a light source 134 in the luminaire 106. In some embodiments, the light source 134 may be at least one light emitting diode (LED) 136. The power output terminals 132 may further be configured to send power to the light source 134.

In some embodiments, the power assembly 118 may further include a circuit board 138. The circuit board 138 may be mounted to the output section 122 of the power assembly 118. Alternatively, all or part of the circuit board 138 may be mounted elsewhere in the luminaire 106 such as, in a non-limiting example, on the side of the perimeter wall 114 inside the luminaire. The power output terminals 132 may be coupled to the data connector 124 through the circuit board 138. Alternatively, the power output terminals 132 may be coupled directly to the data connector 124 and the circuit board 138 may be separately connected to at least one of the data connector and the power output terminals. In one embodiment, the circuit board 138 may include powered device circuitry configured to allow a PoE protocol to detect and classify the luminaire 106.

The assembly including the interface device 100, the luminaire 106, and the power source (such as the PoE router 130) may be configured to cause the illumination of all or a fraction of the LEDs 136. The interface device 100 may be configured to allow for dimming of an associated light source 134, illumination of different color LEDs 136, and the like. Due to the nature of the signal that may be sent through the data cable 126, both power and data may be simultaneously sent to the luminaire 106 through the interface device 100. As such, a program associated with the power source may vary the intensity and color of one or more light sources 134 according to a preprogrammed pattern or according to one or more user commands.

The present invention also relates to a method of powering a luminaire 106. A luminaire 106 may include a knockout opening 104 with a knockout adapter 102 mounted therein. Power from a power over Ethernet (PoE) router 130 may be provided to a power input connector 124 mounted to the knockout adapter 102. The luminaire 106 may be detected and classified in a PoE protocol from the PoE router 130. Power may be transferred from the power input connector 124 to a power output connector 132. Power may be transferred from the power output connector 132 to a light source 134 of the luminaire 106.

Figure 6:
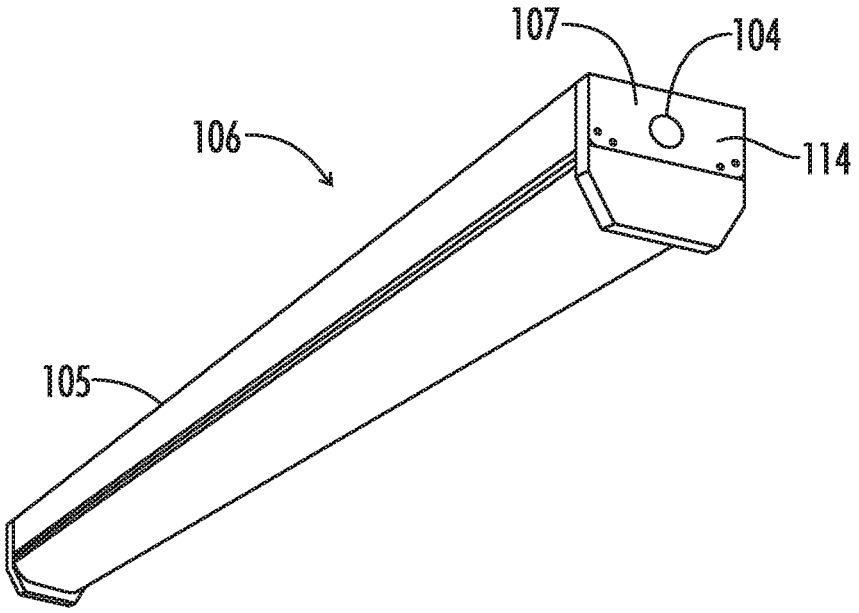
FIG. 6 is a perspective view of an example luminaire including a knockout opening to receive the power over Ethernet interface device of FIG. 1.

Another aspect of the present invention is an LED luminaire 106 having a luminaire housing 105 with at least one housing panel 107 (FIG. 6). At least one LED light source 134 is mounted to the luminaire housing 105. A conduit knockout opening 104 is provided in the at least one housing panel 107. A knockout adapter 102 is mounted to the conduit knockout opening 104. In some embodiments, the knockout adapter 102 has a circular outer perimeter with helical threads to fit and engage the knockout opening 104.

A power assembly 118 having an input section and an output section is connected to the knockout adapter 102 such that the output section of the power assembly 118 is positioned inside the luminaire 106. The power assembly 118 has a data connector 124 mounted to the input section of the power assembly. The power assembly may further include a circuit board 138. The circuit board 138 may be mounted to the output section 122 of the power assembly 118. Power output terminals 132 are coupled to the data connector 124 through the circuit board 138. The data connector 124 is configured to receive PoE signals from a data cable coupled to the data connector.

Thus, although there have been described particular embodiments of the present invention of a new and useful Conduit Knockout Interface Device for Connecting a Power Over Ethernet Cable to an LED Luminaire, it is not intended that such references be construed as limitations upon the scope of this invention except as set forth in the following claims.

What is claimed is:

1. A power over Ethernet (PoE) interface device for use with a luminaire having a conduit knockout opening defined in the luminaire, the PoE interface device comprising:

a knockout adapter configured to be mounted to the luminaire at the conduit knockout opening;

a power assembly connected to the knockout adapter, the power assembly including an input section having a data connector, the data connector configured to couple to a data cable and further configured to receive PoE signals from the data cable, and an output section having power output terminals, the power output terminals electrically connected to the data connector and configured to electrically communicate the PoE signals from the data connector to an LED light source in the luminaire;

wherein the power assembly is configured to pass through the conduit knockout opening defined in the luminaire; and wherein the power assembly is further configured to be positioned inside the luminaire when the knockout adapter is mounted to the luminaire.

2. The PoE interface device of claim 1 wherein:

the power assembly further comprises a circuit board; and the power output terminals are electrically connected to the data connector through the circuit board.

3. The PoE interface device of claim 2, wherein the circuit board is configured to pass through the conduit knockout opening defined in the luminaire.

4. The PoE interface device of claim 1, wherein the circuit board includes powered device circuitry configured to allow a PoE protocol to detect and classify the luminaire.

5. The PoE interface device of claim 1, wherein the data connector is configured to receive the PoE signals from a PoE router.

6. The PoE interface device of claim 1, wherein the knockout adapter includes a circular outer perimeter to fit a corresponding circular knockout opening defined in the luminaire.

7. The PoE interface device of claim 6, wherein the circular outer perimeter includes a helical thread.

8. The PoE interface device of claim 6, wherein the circular outer perimeter has a diameter of substantially 0.5 inches.

9. The PoE interface device of claim 6, wherein the circular outer perimeter has a diameter of substantially 0.75 inches.

10. The PoE interface device of claim 1, wherein the knockout adapter includes a plurality of retaining clips.

11. A power over Ethernet (PoE) interface device for connecting a PoE power source to a luminaire, the luminaire including a light source and a knockout opening defined in the luminaire, the PoE interface device comprising:

a knockout adapter configured to fit the knockout opening; and

LED power circuitry connected to the knockout adapter, the LED power circuitry including:

a circuit board connected to the knockout adapter such that the circuit board may pass through the knockout opening;

a power source connector separate from the knockout adapter and connected to the circuit board, the power source connector configured to receive power from the PoE power source; and a power output connector connected to the circuit board, the power output connector configured to deliver power to the light source.

12. The PoE interface device of claim 11, wherein the PoE power source comprises a PoE router.

13. The PoE interface device of claim 12, wherein the LED power circuitry is configured to allow the PoE router to detect and classify the luminaire.

14. The PoE interface device of claim 13, wherein the knockout adapter is further configured to maintain its position in the knockout opening and to prevent removal up to a threshold removal force.

15. The PoE interface device of claim 11, wherein the knockout opening is substantially 0.5 inches in diameter.

16. The PoE interface device of claim 11, wherein the knockout opening is substantially 0.75 inches in diameter.

17. The PoE interface device of claim 11, wherein:

the knockout adapter is located in the knockout opening of the luminaire;

the power source connector is electrically connected to a PoE router the PoE power source; and the power output connector is electrically connected to the light source, the light source including at least one light emitting diode.

18. An LED luminaire comprising:

a luminaire housing having at least one housing panel;

at least one LED light source mounted to the luminaire housing;

a conduit knockout opening defined in the at least one housing panel, the conduit knockout opening having an opening width;

a knockout adapter mounted in the conduit knockout opening; and a power assembly including:

a circuit board connected to the knockout adapter, the circuit board having a circuit board width smaller than the opening width of the conduit knockout opening to fit through the conduit knockout opening;

a data connector mounted to the circuit board, the data connector configured to receive PoE signals from a data cable; and power output terminals mounted to the circuit board and electrically coupled to the data connector, the power output terminals configured to transmit the PoE signals from the data connector to the LED light source.

19. The LED luminaire of claim 18 wherein:

the power output terminals are coupled to the LED light source through at least one wire.

20. The LED luminaire of claim 18, wherein the knockout adapter has a circular outer perimeter with helical threads to fit and engage the at least one housing panel in the knockout opening.

* * * * *